United States Patent [19]

Olson

[11] 4,284,384

[45] Aug. 18, 1981

[54] APPARATUS FOR AUTOMATICALLY DEPOSITING A LOAD IN A PREDETERMINED POSITION

[75] Inventor: John E. Olson, Portland, Oreg.

[73] Assignee: Cascade Corporation, Portland, Oreg.

[21] Appl. No.: 126,440

[22] Filed: Mar. 3, 1980

[51] Int. Cl.[3] ..... B66F 9/22; B66F 9/24

[52] U.S. Cl. ..... 414/434; 414/497; 414/661

[58] Field of Search ..... 414/434, 437, 439, 441, 414/497, 661

[56] References Cited

U.S. PATENT DOCUMENTS

| | | | |
|---|---|---|---|
| 2,531,560 | 11/1950 | DeWall | 414/439 |
| 2,709,531 | 5/1955 | Mercier et al. | 414/441 |
| 3,110,148 | 11/1963 | Mader et al. | 414/437 X |

*Primary Examiner*—Robert G. Sheridan

*Attorney, Agent, or Firm*—Chernoff & Vilhauer

[57] ABSTRACT

An apparatus for a lift truck, of the type equipped with a push frame, for extending the push frame at a predetermined speed of extension with respect to the lift truck while simultaneously causing the lift truck to move rearwardly at a predetermined reverse speed equal to the speed of extension of the push frame so as to deposit a load in a predetermined position. The apparatus is actuated automatically in response to extension of the push frame.

14 Claims, 4 Drawing Figures

APPARATUS FOR AUTOMATICALLY DEPOSITING A LOAD IN A PREDETERMINED POSITION

BACKGROUND OF THE INVENTION

This invention relates to improvements in apparatus for depositing a load from a lift truck, of the type equipped with a push frame, so that such load may be deposited in a predetermined position and at a predetermined speed without requiring any substantial level of skill on the part of the lift truck operator.

In the past, it has been particularly difficult for lift truck operators to center a load squarely atop another load of similar size, or otherwise deposit a load precisely in a predetermined position, when utilizing a push frame to push the load forwardly off of the load-carrying forks or platen of the lift truck. The problem arises from the fact that it is most difficult to hold the load stationary above the desired deposit position while pushing it forwardly off of the forks since, in order to do so, the lift truck must be driven in reverse at the same speed at which the push frame is extended relative to the lift truck. Such precise synchronization of two separately controllable variable functions, i.e. speed of extension of the push frame and reverse speed of the lift truck, are beyond the capability of all but the most experienced lift truck operators.

Mercier et al U.S. Pat. No. 2,709,531 suggests one type of solution to this problem. This patent discloses a lift truck push frame extension apparatus which is selectively extensible in response to the reverse travel of the lift truck by selective engagement of a clutch through which the wheels drive the push frame extension apparatus. Because the push frame extension apparatus is driven by the wheels the speed of extension is therefore dependent upon the rearward speed of travel of the truck, the mechanical drive linkage from the wheels being such as to cause the speed of extension of the push frame to equal rearward truck speed. However the foregoing basic principle of operation of the Mercier et al system, i.e. the accomplishment of speed equalization by supplying the power for push frame extension from the lift truck wheels, has a number of drawbacks which render the Mercier principle of operation impractical in modern materials handling applications.

One major drawback is that the push frame cannot alternatively be extended independently of vehicle reverse motion. Since there are many load-handling operations which require such independent extension of the push frame for proper load positioning (for example when handling loads of variable size or when obstacles prevent the lift truck from assuming a position of close proximity to the desired deposit location), such limitation is unacceptable.

In addition a system, such as that shown in the Mercier et al patent, which merely equalizes the speed of extension of the push frame with the reverse speed of the lift truck does not control the magnitude of the speed at which the load is deposited. This is still left to the operator whose lack of experience can permit him, for example, to perform the load deposit operation too rapidly for a fragile type or high weight of load which might be involved, and thereby possibly cause load damage, mispositioning of the load or a disturbance of the stability of the load stacks.

Furthermore such a system requires a clutch-engagement step prior to actuating the depositing function.

Such extra step consumes time which, under modern conditions of high-volume materials handling, is multiplied many times and decreases the overall efficiency of the handling operation. Moreover, any extra preparatory step is susceptible to being inadvertently omitted prior to moving the lift truck rearwardly, in which case the lift truck would have to be repositioned and the procedure repeated.

It should be noted that different types of agricultural equipment, such as those shown for example in De Wall U.S. Pat. No. 2,531,560 or Mader et al U.S. Pat. No. 3,110,148 have been devised in the past which also have load-pushing mechanisms powered by, and therefore synchronized with, the wheels of the vehicle. However these essentially operate on the same principle as that of the Mercier et al patent, and therefore do not suggest solutions to the foregoing problems.

SUMMARY OF THE PRESENT INVENTION

In the present invention all of the foregoing drawbacks of the prior art are overcome while providing a significant additional advantage in that existing, conventional lift trucks equipped with push frames can be easily retrofitted to utilize the invention by the addition of a relatively simple, unitized accessory to the lift truck.

Since lift trucks equipped with push frames conventionally have separate power systems for driving the lift truck and extending the push frame respectively (i.e. a motor for driving the wheels and a hydraulic cylinder for extending and retracting the push frame), each being completely separately controllable and thus totally unsynchronized with the other, the present invention retains these separate power systems and their separate controllability so that the push frame can be extended in the absence of vehicle reverse motion simply by actuation of the push frame hydraulic cylinder. The apparatus for equalizing the push frame extension and lift truck reverse speeds, rather than utilizing a principle wherein one power system drives both functions, provides a push frame speed controller interconnected with the hydraulic cylinder for fixing the speed at which the hydraulic cylinder extends the push frame relative to the lift truck.

According to the present invention the push frame speed controller comprises a variably-adjustable, pressure-compensated flow-control valve which is interposed in the lift truck's hydraulic conduit through which fluid is fed to extend the push frame hydraulic cylinder. Such flow-control valve fixes, at a predetermined volumetric flow rate, the flow of fluid through the hydraulic conduit irrespective of variable control valve modulation by the lift truck operator and irrespective of variations in hydraulic pressure caused by variations in load mass, thereby setting the speed of extension of the push frame at a fixed, predetermined speed. Such a flow-control valve is advantageous for controlling push frame speed in this context not only because of its uniformity of speed control irrespective of the foregoing variables, but especially because its insertion into the lift truck hydraulic conduit to fix the speed of push frame extension can be accomplished very easily as part of a retrofitted installation merely by cutting the lift truck's hydraulic conduit and attaching extension conduits to the pair of cut ends thus formed, such extension conduits extending to any remote location on the lift truck where it is convenient to mount the flow-control valve as part of a small, unitized accessory.

The accessory also includes a lift truck speed controller connected to the lift truck drive motor which, when actuated, fixes the normally variable speed at which the motor drives the lift truck rearwardly at a fixed, predetermined reverse speed substantially equal to the speed of extension of the push frame as fixed by the flow-control valve.

Rather than requiring multiple actuation steps to employ the speed equalization system of the present invention, a synchronizing apparatus responsive to actuation of the hydraulic cylinder to extend the push frame is provided which initiates reverse motion of the lift truck at the aforementioned predetermined speed automatically in response to the operator's actuation of the hydraulic cylinder. According to the present invention, this synchronizing apparatus comprises a hydraulically-controlled synchronizing switch which is spring-biased to its open position but which closes automatically in response to the sensing, through a pilot line, of hydraulic pressure to extend the hydraulic cylinder which extends the push frame. The hydraulic synchronization provided by such a switch is highly advantageous, as compared to other types of synchronization, from a point of view of facilitating the retrofitting of existing conventional lift trucks since it merely requires the interconnection of a pilot line with the lift truck's hydraulic conduit through which fluid is supplied to extend the push frame. In fact, when employed in combination with the aforementioned flow-control valve, the pilot line for actuating the hydraulically-controlled synchronizing switch requires no independent connection but may be included entirely within the unitized accessory interconnected with the inlet of the flow-control valve.

In a synchronized system of this type, which initiates reverse motion of the lift truck automatically in response to the operator's actuation of the push frame to extend it, it is conceivable that the operator could inadvertently actuate the push frame while the lift truck is being driven forwardly thereby abruptly reversing drive power. To guard against any such event the present invention also includes apparatus, preferably sensitive to the operator's depression of the accelerator pedal, which prevents initiation of lift truck reverse motion in response to actuation of the push frame if drive power is being supplied to the lift truck at the time of such actuation of the push frame. Preferably such apparatus prevents the initiation of lift truck reverse motion only when drive power is being supplied in forward drive mode.

Also in a synchronized system of this type it is conceivable that the operator could be standing beside the lift truck (rather than being seated in the driver's seat), or be depressing the lift truck brake pedal, when he actuates the push frame to extend it. In either of such cases it would not be desirable to initate lift truck reverse motion in response to actuation of the push frame, and the improved apparatus of the present invention includes means for automatically preventing initiation of lift truck reverse motion in such instances.

It is accordingly a primary objective of the present invention to provide an improved apparatus for automatically equalizing push frame extension speed and lift truck reverse speed which is compatible with maintaining separately-controllable, independent power sources for push frame extension and lift truck travel respectively and which can easily be installed as a unitized accessory on existing lift trucks equipped with push frames.

It is a further objective of the invention to provide such an apparatus which not only equalizes push frame extension speed and lift truck reverse speed, but also fixes such speeds at a predetermined magnitude which is independent of variations in mass of the load.

It is a further objective of the invention to make actuation of the foregoing apparatus hydraulically responsive automatically to actuation of the push frame to extend it.

It is a further objective of the invention to provide means for automatically preventing such automatic actuation if drive power is being supplied to the lift truck, if the lift truck operator is not seated in the driver's seat, or if the lift truck brakes are applied at the time the push frame is actuated.

The foregoing and other objectives, features, and advantages of the invention will be more readily understood upon consideration of the following detailed description of the invention, taken in conjunction with the accompanying drawings.

DESCRIPTION OF THE PREFERRED EMBODIMENT

Figure 1:
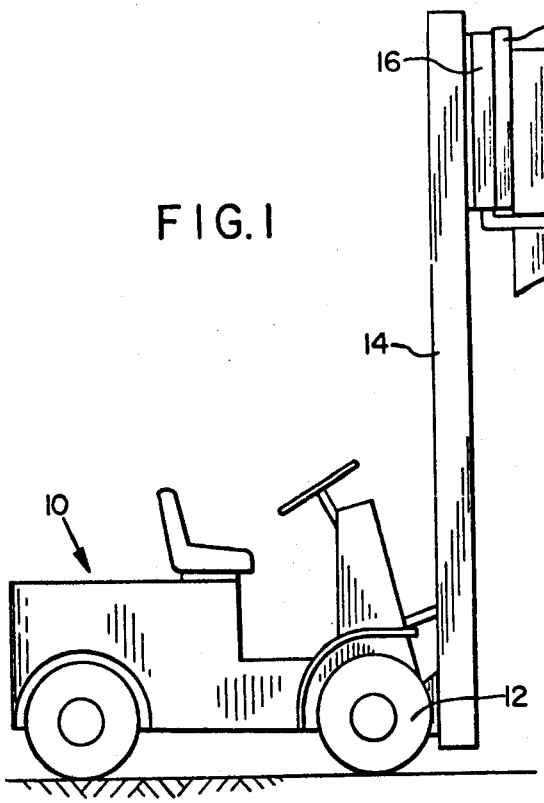
FIG. 1 is a side view of an exemplary lift truck equipped with a push frame, shown supporting a load in position for deposit atop another load.

FIG. 1 depicts a typical electric lift truck 10 having drive wheels 12, driven by an electric motor to be discussed hereafter, for moving the lift truck selectively forwardly and rearwardly. A load-lifting mast 14 is mounted at the front of the lift truck 10 and has a load carriage 16 mounted thereon so as to move vertically. The load carriage 16 in turn has a load-carrying member, such as a platen or a pair of load-carrying forks 18 (only one of which is shown), for supporting a load 20 and a selectively extensible and retractable push frame 22 mounted thereon. In many cases the push frame 22 will be equipped with a slip sheet clamp extending transversely along its bottom edge (not shown), such slip sheet clamp being automatically closable in response to retraction of the push frame and automatically openable in response to extension of the push frame. Extension of the push frame 22 to push a load forwardly off of the forks 18, or retraction thereof to pull a load rearwardly onto the forks, is accomplished by a pantographic linkage 24 (FIG. 2) powered by a selectively extensible and retractable hydraulic cylinder to be explained more fully hereafter.

Figure 3:
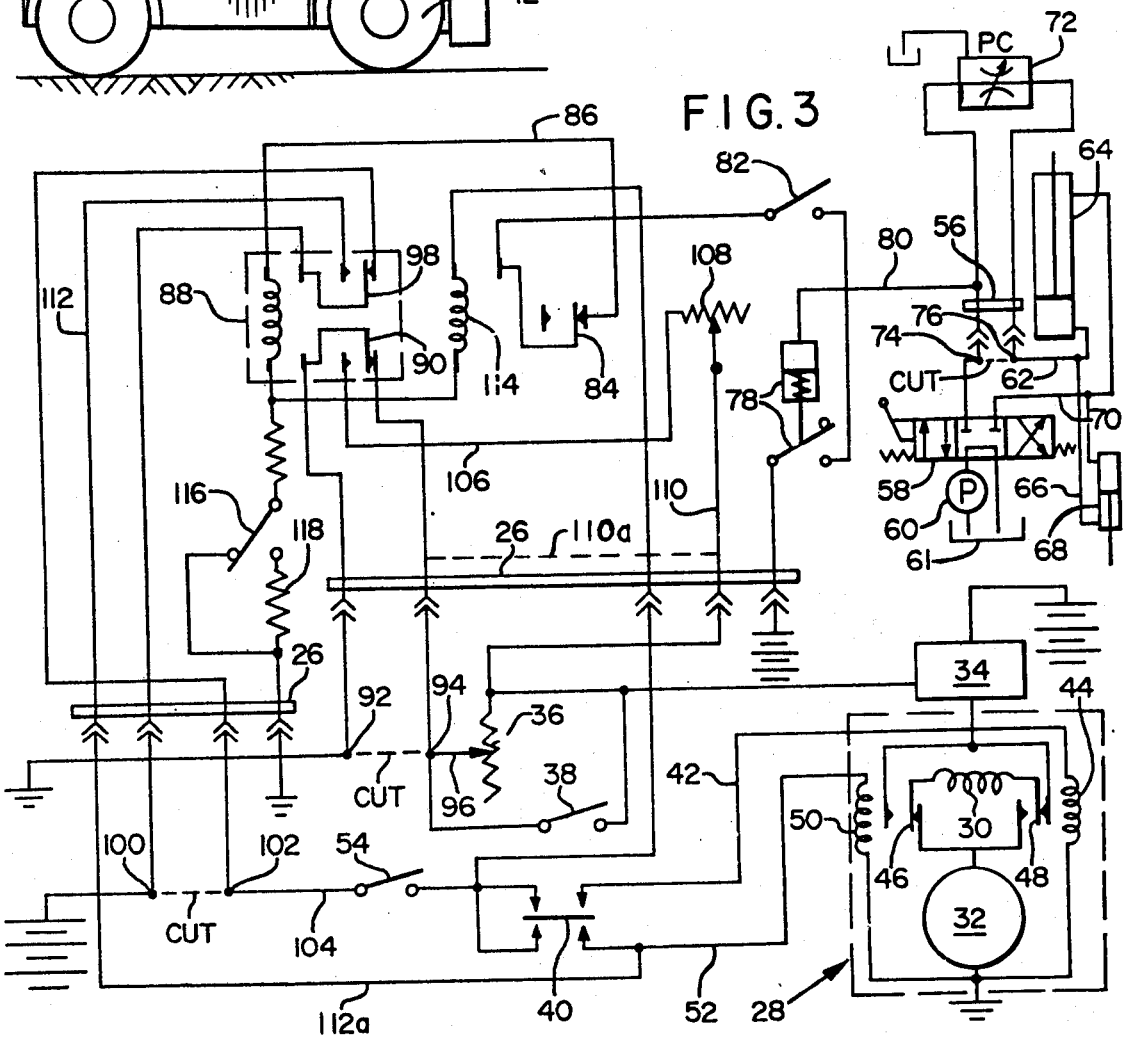
FIG. 3 is a schematic diagram showing simplified exemplary electrical drive motor and hydraulic push frame circuits of the lift truck of claim 1, as modified by the addition of an accessory which changes the operation of such electrical and hydraulic circuits in accordance with the present invention.

With reference to FIG. 3, the electrical drive circuit of a typical electric lift truck such as 10 is shown in simplified form as that portion of the figure connected below the electrical junction panels 26 and is entirely conventional except for the two electrical conductor interruptions which have been labeled with the notation "cut", and the addition of a line 112*a*. In order best to understand the operation of the present invention, the normal operation of the lift truck electric drive circuit will first be explained. An electric drive motor indicated generally as 28 is composed of a field 30 and armature 32 and is connected by a conventional mechanical drive train (not shown) to the drive wheels 12. Speed of the lift truck is controlled by a conventional silicon controlled rectifier (SCR) 34 inserted between the truck battery and drive motor 28. The SCR is a solid state rectifier with silicon as the primary semiconductor material which operates as a high-speed switch which provides the motor with battery voltage in variable bursts or pulses, resulting in a variable average voltage applied to the motor which varies its speed and thus the speed of the lift truck 10. SCR pulse variation in turn is controlled by a variable resistor 36 controllably connected to the lift truck operator's accelerator pedal. When full power is required by the operator, full depression of the accelerator pedal closes a switch 38 which bypasses the variable resistor 36.

The direction in which the motor 28 is driven, and thus the direction of the truck, is determined by an operator-controlled forward-reverse switch 40. When moved to its upper position, switch 40 completes a circuit through line 42 which energizes relay 44 moving the associated switches 46 and 40 to their right-hand positions as shown in FIG. 3 causing current to flow through motor field 30 in a direction so as to drive the lift truck forwardly. Alternatively, if switch 40 is moved to its lower position, it energizes relay 50 through line 52 causing switches 46 and 48 to move to the left and thereby causing current to flow through field 30 in the opposite direction, thereby driving the lift truck rearwardly. Switch 54 is controlled by the accelerator and is closed, permitting completion of a circuit through switch 40, only if the accelerator is at least partially depressed.

Also in FIG. 3 is a simplified portion of the hydraulic circuit of the lift truck 10 by which the extension and retraction of the push frame 22 is accomplished, shown connected below a hydraulic junction panel 56. This portion of the lift truck's hydraulic circuit is completely conventional except for the interruption in the hydraulic line 62 indicated by the notation "cut". In normal operation, extension of the push frame 22 is accomplished by movement of the spool of the manually-controlled hydraulic valve 58 to the right as shown in FIG. 3. This actuates a battery-driven electric pump 60 through a conventional switching circuit (not shown), causing the pump 60 to draw hydraulic fluid from reservoir 61 and supply it under pressure through conduit 62 to extend hydraulic cylinder 64. The piston rod of the cylinder 64 is connected to the pantographic linkage 24 in a conventional manner and extends the linkage and push frame 22. If the lift truck 10 is equipped with a slip sheet clamp, movement of the valve 58 to the right initially causes the pressurized fluid supplied to conduit 62 to be supplied through conduit 66 to retract a slip sheet clamp cylinder 68, thereby releasing the slip sheet clamp. Because substantially less pressure is required to release the slip sheet clamp than is required to extend the push frame 22, initial retraction of the slip sheet clamp cylinder 68 will precede initial extension of the push frame cylinder 64 by a time period necessary to cause full retraction of the cylinder 68. This time period will depend upon the flow rate of hydraulic fluid through line 62. Conversely, movement of the spool of valve 58 to the left in FIG. 3 introduces pressurized fluid into conduit 70 and causes retraction of the cylinder 64 and push frame 22, preceded by extension of cylinder 68 to close the slip sheet clamp.

Figure 2:
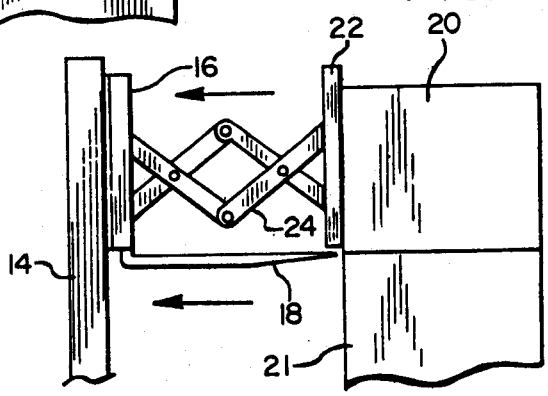
FIG. 2 is a partial side view of the lift truck of FIG. 1 showing the relationship of the lift truck and push frame with respect to the load after the load has been deposited properly in position atop the other load.

From the foregoing discussion of the lift truck's conventional electrical drive and hydraulic push frame circuits, it will be appreciated that the two systems are controllable totally independently of one another. That is, speed and direction of the lift truck are controlled solely by the operator's depression of the accelerator pedal and his manual control of switch 40, while speed and direction of the push frame 22 relative to the lift truck are controlled manually by the selective movement and modulation of valve 58. The independent operation of these two systems, for reasons discussed earlier, is highly desirable and useful in many circumstances and should be retained. However, when a lift truck operator wishes to deposit a load 20 atop another load 21 as shown in FIGS. 1 and 2, or otherwise deposit the load precisely in a predetermined position, such independent operation of the two systems requires an unusually high degree of skill on the part of the operator to accurately deposit the load 20 squarely atop the load 21. Conventionally the operator would drive the lift truck 10 forwardly until the load 20 were positioned as shown in FIG. 1, and then would extend the push frame 22 while simultaneously driving the lift truck rearwardly as shown in FIG. 2 to accomplish the deposit. It will be appreciated that this maneuver requires simultaneous modulation of the valve 58 and lift truck accelerator in such a manner as to cause the reverse speed of the truck to equal the speed of extension of the push frame relative to the lift truck. Unfortunately, in most high-volume load-handling operations, the experience level of the average lift truck operator is insufficient to accomplish this maneuver successfully and efficiently.

Accordingly, according to the present invention, an accessory is added to the lift truck 10 modifying the conventional electrical drive and hydraulic push frame circuits previously discussed with respect to FIG. 3. The circuit portions added by the accessory are shown in the portions of FIG. 3 connected above the electrical junction panels 26 and hydraulic junction panel 56 respectively. Installation of the accessory also involves cutting of the lift truck's electrical and hydraulic conduits at the three places indicated by the notation "cut", and adding an electrical conduit 112*a*.

The hydraulic portion of the accessory comprises a variably-adjustable, pressure-compensated flow-control valve 72 of a conventional priority flow divider type which is interposed between junctions 74 and 76 formed by the cut in hydraulic conduit 62 through which fluid is fed for extending cylinder 64 and push frame 22. Valve 72 fixes, at a predetermined volumetric flow rate, the flow of fluid through line 62 irrespective of the operator's variable modulation of valve 58 or the pressure of the fluid as determined by the mass of the load being pushed by the cylinder 64, thereby setting the speed of extension of the push frame 22 relative to the lift truck at a fixed predetermined speed which can be adjusted only by adjustment of the variable flow-control valve 72. It will be appreciated that the flow-control valve 72 is of relatively small size and highly adaptable for inclusion as part of a retrofitted unitized accessory which can be located at any convenient location in the operator's compartment. Such location need not be adjacent the conduit 62 because of the ease of connecting the valve thereto by flexible hydraulic hoses.

The accessory also includes a hydraulically-controlled synchronizing switch 78 which is spring-biased to its open position but which closes automatically in response to the sensing of pressure, through pilot line 80, at the inlet side of flow control valve 72, such pressure indicating the actuation by the operator of valve 58 to extend the push frame. The hydraulic interconnection of switch 78 with the existing lift truck hydraulic circuit can be easily and quickly made in a retrofit installation, and in fact can be self-contained in the accessory unit, requiring no extra installation step, if the accessory controls speed of extension of the push frame by a flow-control valve such as 72.

Closure of switch 78 in response to actuation of valve 58 to extend the push frame 22 completes a circuit through normally-closed switches 82 and 84 and line 86 through a double switch, time-delay relay assembly 88 which is also part of the unitized accessory. Relay assembly 88 may, for example, be a conventional solid state time-delay relay such as a model TIK-10-462 manufactured by National Controls Corporation of Lombard, Illinois having a variable time-delay setting of 0.1–10 seconds. It will be noted that one of the switches 90 of the relay 88 is interposed between junctions 92 and 94 formed by the cut in line 96 of the lift truck's drive speed control circuit. Switch 90 is referred to herein as a speed selector switch. The other switch 98 of relay 88 is interposed between junctions 100 and 102 formed by the cut in line 104 of the lift truck's forward-reverse direction control circuit. Switch 98 is referred to herein as a direction-selector switch.

When both switches 90 and 98 are in their unactuated positions as shown in FIG. 3 due to the open condition of synchronizing switch 78, normal circuits are completed through both lines 96 and 104 of the lift truck's speed and direction-control circuits respectively, and speed and direction of the lift truck are controlled normally by the operator. However, upon the operator's actuation of push frame control valve 58 to extend cylinder 64 and thus the push frame, synchronizing switch 78 is closed in response to the supply of pressurized fluid to line 62. This completes a circuit through the time-delay relay assembly 88 which, after the initial time delay which has been preset in the relay 88, causes both relay switches 90 and 98 to move to the left in FIG. 3 thereby interrupting normal current flow through lift truck lines 96 and 104 respectively. Instead, speed selector switch 90 now directs current through line 106, through a variably settable resistor 108 and thence through line 110 to the SCR assembly 34, thereby replacing accelerator-controlled variable resistor 36 as the means for controlling speed of the motor 28 through the SCR assembly 34.

Concurrently with the above-described actuation of speed-selector switch 90, direction-selector switch 98 is also moved to the left in FIG. 3 thereby interrupting normal current flow through line 104 of the lift truck's direction-control circuit. Rather current is instead conducted through line 112 and line 112*a*, replacing switches 40 and 54 as the means by which drive direction is controlled. Such current is thereby conducted only to relay 50 which causes motor switches 46 and 48 to move to the left in FIG. 3 driving the lift truck in a rearward direction, the speed of rearward movement being fixed by the setting of variable resistor 108.

Proper adjustment and synchronization of the foregoing speed and direction control functions is preferably accomplished during installation of the accessory by first adjustably setting the flow rate through variable flow-control valve 72 so as to achieve the desired speed of extension of the push frame 22 relative to the lift truck. Once the flow-control valve 72 has been set, the push frame is extended and the delay, if any, between actuation of valve 58 and actual initiation of extension, due to retraction of cylinder 68 to release a slip sheet clamp if the truck is so equipped, is timed. The time-delay adjustment of relay 88 is then set so as to equal the observed time delay. Thereafter variable resistor 108 of the accessory is set so as to cause lift truck reverse speed to equal the preset speed of extension of the push frame 22 relative to the lift truck. Accordingly, merely by the operator's actuation of valve 58 to extend the push frame 22, the entire system will automatically be actuated to drive the lift truck rearwardly in a synchronized fashion with respect to push frame extension and at a reverse speed equal to the speed of extension.

Switches 82 and 84 of the accessory are both override switches which selectively permit or prevent actuation of the speed selection and direction control functions of the accessory. Switch 82 is merely a manually-controlled switch which the operator can open to prevent actuation of the system when extension of the push frame independently of any lift truck movement is desired. Switch 84 is controlled by relay 114 which is responsive to the flow of any current through switch 54 and line 104 of the lift truck's direction-control circuit caused by any depression of the accelerator pedal. If such current is sensed, indicating the supply of drive power to the motor 28, relay 114 opens switch 84 and prevents actuation of the system. This could occur, for example, if the valve 58 has been inadvertently actuated to extend the push frame while the operator is depressing the accelerator. Since the operator's depression of the accelerator can cause the truck to move during the time delay period set in relay 88, the truck could conceivably be moving forward at the time when the relay switch 98 causes the drive motor to drive the truck in reverse. However relay 114 and switch 84 sense any such potential conflict and interrupt the synchronous operation of the automatic functions before such a conflict can occur.

Switch 116 of the accessory selectively includes or eliminates a voltage step-down resistor 118 from the actuation circuits of the relays 88 and 114, and is provided to adapt the accessory for installation on lift trucks of different battery voltages. For example, switch 116 would bypass resistor 118 (as shown in FIG. 3) if the lift truck were equipped with a 36 volt battery capacity, but would be switched to its nonbypassing position during installation if the lift truck were equipped with a 48 volt battery capacity.

Figure 4:
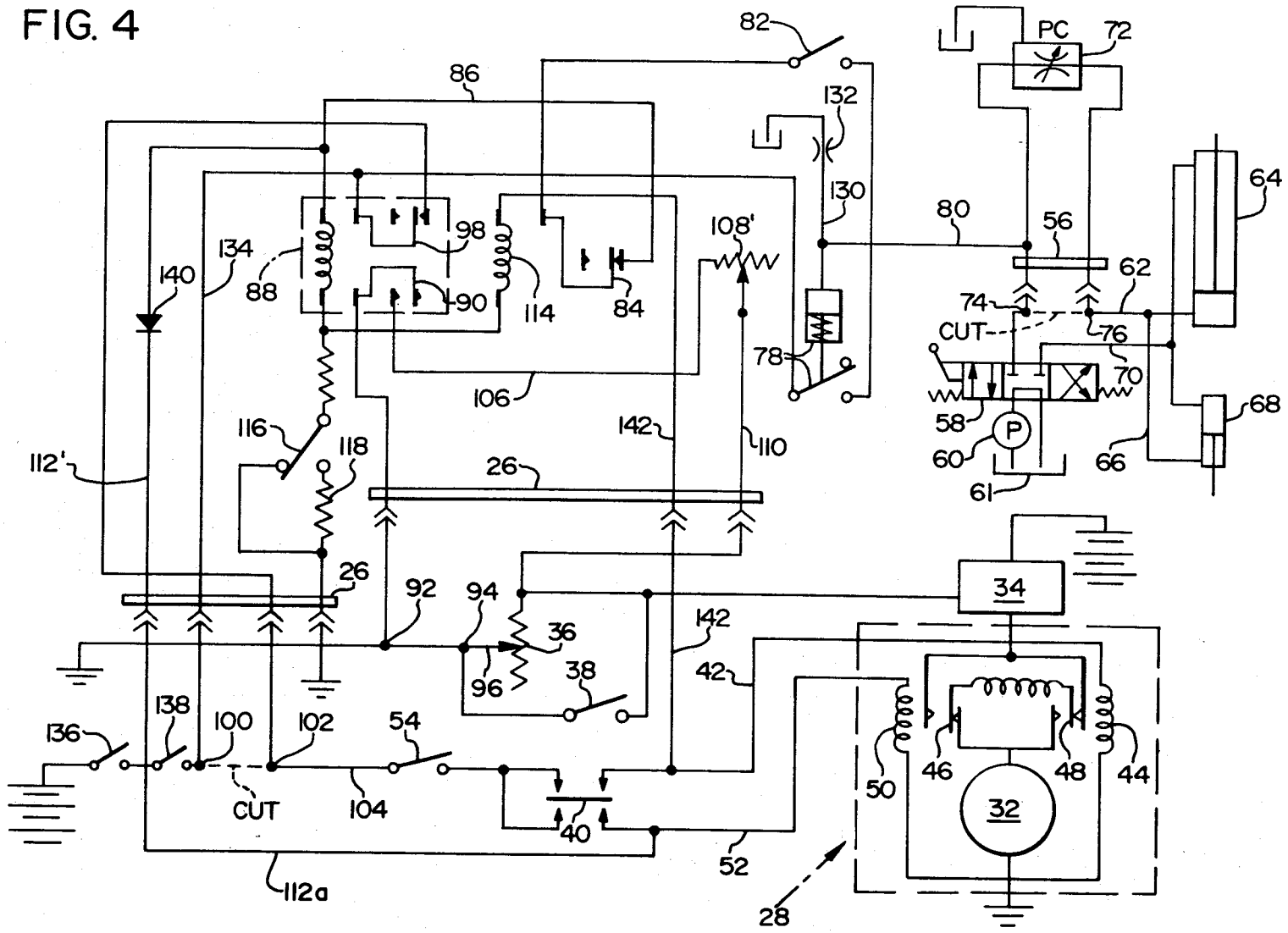
FIG. 4 is a schematic diagram of a further improved embodiment of the circuitry of FIG. 3.

Turning now to FIG. 4, a further embodiment of the improved circuitry of FIG. 3 is shown having still further improvement features not included in the embodiment of FIG. 3. Because many element are common to both FIGS. 3 and 4, FIG. 4 shows the same reference numerals for these common elements. Accordingly the discussion with respect to FIG. 4 will be limited to those features which are different from the circuitry of FIG. 3.

First, in connection with the hydraulically-controlled synchronizing switch 78, it is noted that pilot line 80 is vented to the hydraulic reservoir 61 by means of a pressure relief line 130 having a restriction 132 therein. This is to ensure that the synchronizing switch 78 is permitted to open at all times that the valve 58 is not actuated to extend the push frame by relieving any possible residual pressure which may remain at the inlet side of flow-control valve 72 after valve 58 is closed.

Additionally, it will be noted that, in the embodiment of FIG. 4, switch 78 does not require a separate electrical connection to the battery of the lift truck through an electrical junction panel 26 but rather is internally connected, within the accessory, to line 134 which, as in FIG. 3, is connected to junction 100 formed by the cut in line 104 of the lift truck's direction-control circuit. One of the advantages provided by this arrangement is that installation of the accessory is simplified by eliminating one electrical interconnection with the lift truck. More importantly, however, such arrangement interposes into the actuation circuitry of the accessory two additional override switches which selectively permit or prevent actuation of the speed selection and direction-control functions of the accessory. The switches referred to are a conventional part of the lift truck's direction-control circuit and include seat switch 136 and brake switch 138 interposed in line 104. Seat switch 136 is a normally open switch which closes only in response to the operator's weight on the driver's seat. Thus completion of a circuit through direction-control switch 40 to drive the lift truck either forwardly or rearwardly is permitted only if the operator is properly seated, thereby closing switch 136. Likewise, the interconnection of synchronizing switch 78 through line 134 with junction 100 and switch 136 prevents the completion of a circuit through switch 78 if the operator is not properly seated. This permits the operator to extend the push frame while standing alongside the lift truck, as is sometimes necessary, while automatically being protected against inadvertent and unexpected rearward motion of the lift truck.

Brake switch 138, which is also a conventional element of the lift truck's direction-control circuit, is normally closed but opens in response to the operator's application of the lift truck brakes, thereby interrupting the flow of current through switch 40 and thereby interrupting the transmission of drive power. Accordingly, due to the interconnection of synchronizing switch 78 with junction 100, brake switch 138 likewise prevents the completion of a circuit through switch 78 when the lift truck brakes are applied, thereby preventing actuation of the speed selection and direction-control functions of the accessory even though the push frame may be actuated to extend it.

A further modified feature of FIG. 4, which both facilitates installation of the accessory and illustrates the versatility of the accessory as applied to different types of lift truck circuitry, involves the modified interconnection of the accessory with the lift truck drive speed control circuit. It will be noted that there is no cut in FIG. 4 between junctions 92 and 94 in line 96 of the speed-control circuit, and that switch 90 of the time-delay relay 88 and variable resistor 108' of the accessory are connected in parallel with line 96. This eliminates the need for an electrical connection between junction 94 and switch 90 as shown in FIG. 3. This parallel type of arrangement is effective where the interaction of the SCR 34 with the lift truck's accelerator-controlled variable resistor 36 is such that the average voltage applied to the lift truck drive motor by the SCR (and thus the speed of the truck) has an inverse relationship to the amount of resistance provided by the resistor 36. Thus when the truck is stopped the resistance of resistor 36 is high, and when extension of the push frame inserts resistor 108' in parallel with resistor 36, the effective resistance is lowered causing the vehicle to move. In some lift trucks however, the relationship is the opposite, i.e. average voltage applied to the drive motor increases with the value of the resistance 36. When the accessory is applied to this latter type of lift truck a cut between junctions 92 and 94 must be made and an arrangement such as that shown in FIG. 3 can be used or, alternatively, line 110 of the accessory can be connected to junction 94 through a line **110*a* (FIG. 3) so that the resistor 108 is in series with, rather than replaces, resistor 36 when the accessory is actuated. This latter approach would eliminate the separate connection between line 110** of the accessory and the lift truck, thereby facilitating installation of the accessory.

A further modified feature of FIG. 4 is the interconnection of line 112' directly to the main actuation circuit 86 of the accessory, rather than to switch 98 of the time-delay relay assembly 88. This causes the accessory to place the lift truck drive motor in reverse mode through lines 112' and **112*a* prior to the introduction of drive power through the lift truck's speed-control circuit which is time delayed by switch 90 when the accessory is actuated. This arrangement is preferable to that of FIG. 3 because the drive circuit of some lift trucks requires actuation of the direction-control circuit prior to actuation of the speed-control circuit. In this arrangement a diode 140 is inserted in line 112'** of the accessory to prevent feedback through this line which could actuate the accessory (thereby fixing truck speed after the time delay) in response to the operator's attempt to drive the lift truck in reverse in a normal manner.

Finally, it will be noted that in FIG. 4 line 142, which actuates relay 114 and thus opens override switch 84 in response to the supply of drive power to the motor 28, is connected to the lift truck direction-control circuit on the opposite side of switch 40 as compared to the arrangement in FIG. 3. This prevents actuation of the system in response to the supply of drive power only when the truck is in forward drive mode, and not when it is in reverse mode which would be consistent with the desired direction of movement when the push frame is extended.

It should be noted that, although the system of the present invention is shown in its preferred form adapted to an electric lift truck, the principle of operation of the system could be adapted in an equivalent manner to a lift truck powered by an internal combustion engine by providing, for example, a hydraulically or electrically actuated drive speed control in the nature of a settable engine rpm governor which fixes engine rpm and thus vehicle speed, and a hydraulically or electrically actuated transmission direction controller which places the transmission in reverse, all automatically in response to extension of the push frame in the manner previously discussed.

The terms and expressions which have been employed in the foregoing specification are used therein as terms of description and not of limitation, and there is no intention, in the use of such terms and expressions of excluding equivalents of the features shown and described or portions thereof, it being recognized that the scope of the invention is defined and limited only by the claims which follow.

What is claimed is:

1. In a lift truck having a prime mover for selectively driving said lift truck rearwardly, a load-carrying member extending forwardly from said lift truck, a selectively extensible and retractable push frame mounted on said lift truck for pushing a load from said load-carrying member in a direction forwardly of said lift truck by extension of said push frame with respect to said lift truck, selectively actuated hydraulic power means connected to said frame for extending said push frame in response to the supply of hydraulic fluid under pressure thereto through a conduit and speed control means associated with said prime mover for causing said prime mover to drive said lift truck rearwardly at a fixed, predetermined reverse speed, the improvement which comprises hydraulic flow-control valve means interposed in said conduit for fixing, at a predetermined volumetric flow rate, the flow of said hydraulic fluid therethrough so as to cause said hydraulic power means to extend said push frame at a fixed, predetermined speed of extension with respect to said lift truck which is substantially equal to said fixed, predetermined reverse speed of said lift truck.

2. The lift truck of claim 1 wherein said flow-control valve includes adjustable means for variably adjusting said predetermined volumetric flow rate of hydraulic fluid therethrough.

3. The lift truck of claim 1 wherein said flow-control valve includes pressure-compensating means for causing said predetermined volumetric flow rate of hydraulic fluid therethrough to remain constant despite variations in the pressure of said hydraulic fluid.

4. In a lift truck having a prime mover for selectively driving said lift truck rearwardly, a load-carrying member extending forwardly from said lift truck, a selectively extensible and retractable push frame mounted on said lift truck for pushing a load from said load-carrying member in a direction forwardly of said lift truck by extension of said push frame with respect to said lift truck and selectively actuated hydraulic power means connected to said push frame for extending said push frame in response to the supply of hydraulic fluid under pressure thereto through a conduit, the improvement which comprises hydraulic synchronizing means responsive to the pressure of said hydraulic fluid supplied to said hydraulic power means and connected to said prime mover for actuating said prime mover to drive said lift truck rearwardly in response to actuation of said hydraulic power means to extend said push frame.

5. The lift truck of claim 4 wherein said hydraulic synchronizing means includes sensing means for sensing said pressure, and hydraulic pressure relief means for relieving the pressure sensed by said sensing means when said hydraulic power means is not actuated to extend said push frame.

6. The lift truck of claim 4 including a hydraulic flow-control valve means interposed in said conduit for fixing, at a predetermined volumetric flow rate, the flow of said hydraulic fluid therethrough so as to cause said hydraulic power means to extend said push frame at a fixed, predetermined speed of extension with respect to said lift truck, said hydraulic synchronizing means being responsively connected to said conduit at a location along said conduit separated from said hydraulic power means by said flow-control means.

7. The lift truck of claim 4 including selectively actuated means connected to said prime mover for causing said prime mover to drive said lift truck rearwardly at a reverse speed substantially equal to the speed of extension of said push frame with respect to said lift truck, said hydraulic synchronizing means including means for actuating said selectively actuated means simultaneously with said actuation of said prime mover.

8. In a lift truck having a prime mover for selectively driving said lift truck forwardly or rearwardly upon the application of drive power thereto, a load-carrying member extending forwardly from said lift truck, a selectively extensible and retractable push frame mounted on said lift truck for pushing a load from said load-carrying member in a direction forwardly of said lift truck by extension of said push frame with respect to said lift truck, selectively actuated push frame power means connected to said push frame for extending said push frame and synchronizing means connecting said prime mover responsively to said push frame power means for actuating said prime mover to drive said lift truck rearwardly in response to actuation of said push frame power means to extend said push frame, the improvement which comprises override means responsive to the application of drive power to said prime mover and connected to said synchronizing means for preventing said actuation of said prime mover by said synchronizing means whenever said actuation of said push frame power means occurs while drive power is being applied to said prime mover.

9. The lift truck of claim 8 wherein said override means includes means for preventing said actuation of said prime mover whenever said actuation of said push frame power means occurs while drive power is being applied to said prime mover to drive said lift truck forwardly, but not while drive power is being applied to said prime mover to drive said lift truck rearwardly.

10. In a lift truck having an operator's seat, operator-sensing means for sensing the presence or absence of an operator in said seat, a prime mover for selectively driving said lift truck upon the application of drive power thereto, a load-carrying member extending forwardly from said lift truck, a selectively extensible and retractable push frame mounted on said lift truck for pushing a load from said load-carrying member in a direction forwardly of said lift truck by extension of said push frame with respect to said lift truck, selectively actuated push frame power means connected to said push frame for extending said push frame and synchronizing means connecting said prime mover responsively to said push frame power means for actuating said prime mover to drive said lift truck rearwardly in response to actuation of said push frame power means to extend said push frame, the improvement which comprises means responsive to said operator-sensing means and connected to said synchronizing means for preventing said actuation of said prime mover by said synchronizing means whenever said actuation of said push frame power means occurs while said operator-sensing means senses the absence of an operator in said operator's seat.

11. In a lift truck having selectively-applied brakes for stopping the travel of said lift truck, brake-sensing means for sensing the application of said brakes, a prime mover for selectively driving said lift truck upon the application of drive power thereto, a load-carrying member extending forwardly from said lift truck, a selectively extensible and retractable push frame mounted on said lift truck for pushing a load from said load-carrying member in a direction forwardly of said lift truck by extension of said push frame with respect to said lift truck, selectively-actuated push frame power means connected to said push frame for extending said push frame and synchronizing means connecting said prime mover responsively to said push frame power means for actuating said prime mover to drive said lift truck rearwardly in response to actuation of said push frame power means to extend said push frame, the improvement which comprises means responsive to said brake-sensing means and connected to said synchronizing means for preventing said actuation of said prime mover by said synchronizing means whenever said actuation of said push frame power means occurs while said brakes are being applied.

12. In a lift truck having an electric motor prime mover for selectively driving said lift truck rearwardly, first and second resistors respectively for controlling the supply of electrical power to said electric motor and thereby controlling the speed at which said lift truck is driven rearwardly by said electric motor, a load-carrying member extending forwardly from said lift truck, a selectively extensible and retractable push frame mounted on said lift truck for pushing a load from said load-carrying member in a direction forwardly of said lift truck by extension of said push frame with respect to said lift truck, selectively-actuated push frame power means connected to said push frame for extending said push frame, and means connected to said push frame power means for causing said push frame power means to extend said push frame at a speed of extension with respect to said lift truck, the improvement which comprises selectively-controlled speed-selector means comprising switch means connected responsively to said push frame power means for alternatively causing said first resistor alone to control the speed at which said lift truck is driven rearwardly by said electric motor or, in response to actuation of said push frame power means to extend said push frame, for interconnecting said first and second resistors in parallel with each other so as to control the speed at which said lift truck is driven rearwardly by said electric motor.

13. In a lift truck having an electric motor prime mover for selectively driving said lift truck rearwardly, first and second resistors respectively for controlling the supply of electrical power to said electric motor and thereby controlling the speed at which said lift truck is driven rearwardly by said electric motor, a load-carrying member extending forwardly from said lift truck, a selectively extensible and retractable push frame mounted on said lift truck for pushing a load from said load-carrying member in a direction forwardly of said lift truck by extension of said push frame with respect to said lift truck, selectively-actuated push frame power means connected to said push frame for extending said push frame, and means connected to said push frame power means for causing said push frame power means to extend said push frame at a speed of extension with respect to said lift truck, the improvement which comprises selectively-controlled speed-selector means comprising switch means connected responsively to said push frame power means for alternatively causing said first resistor alone to control the speed at which said lift truck is driven rearwardly by said electric motor or, in response to actuation of said push frame power means to extend said push frame, for interconnection said first and second resistors in series with each other so as to control the speed at which said lift truck is driven rearwardly by said electric motor.

14. In a lift truck having a prime mover for selectively driving said lift truck rearwardly, a load-carrying member extending forwardly of said lift truck, a selectively extensible and retractable push frame mounted on said lift truck for pushing a load from said load-carrying member in a direction forwardly of said lift truck by extension of said push frame with respect to said lift truck, selectively-actuated push frame power means connected to said push frame for extending said push frame at a speed of extension with respect to said lift truck, speed-control means associated with said prime mover for controlling the speed at which said lift truck is driven rearwardly by said prime mover, direction control means associated with said prime mover for selectively causing said prime mover to drive said lift truck in a rearward direction, and synchronizing means connecting said speed-control means and direction-control means responsively to said push frame power means for actuating said speed-control means and direction-control means respectively to drive said lift truck rearwardly in response to actuation of said push frame power means to extend said push frame, the improvement which comprises time-delay means associated with said speed-control means for delaying said actuation of said speed-control means in response to said actuation of said push frame power means by a predetermined time period after said actuation of said direction-control means in response to said actuation of said push frame power means.

* * * * *

UNITED STATES PATENT AND TRADEMARK OFFICE

CERTIFICATE OF CORRECTION

PATENT NO. : 4,284,384

DATED : August 18, 1981

INVENTOR(S) : John E. Olson

It is certified that error appears in the above-identified patent and that said Letters Patent are hereby corrected as shown below:

Col. 8, line 63 Change "element" to --elements--.

Col. 11, line 12 Insert the word "push" before the word "frame" (first occurrence).

Signed and Sealed this

Tenth Day of November 1981

[SEAL]

*Attest:*

GERALD J. MOSSINGHOFF

*Attesting Officer*

*Commissioner of Patents and Trademarks*